US009126092B2

(12) United States Patent
Deacon

(10) Patent No.: US 9,126,092 B2
(45) Date of Patent: Sep. 8, 2015

(54) GOLF CLUB FACE ALIGNMENT TRAINING AID

(71) Applicant: Sean Richard Harry Deacon, Tempe, AZ (US)

(72) Inventor: Sean Richard Harry Deacon, Tempe, AZ (US)

(73) Assignee: AME Golf LLC, Tempe, AZ (US)

( * ) Notice: Subject to any disclaimer, the term of this patent is extended or adjusted under 35 U.S.C. 154(b) by 59 days.

(21) Appl. No.: 13/955,773

(22) Filed: Jul. 31, 2013

(65) Prior Publication Data

US 2015/0038248 A1 Feb. 5, 2015

(51) Int. Cl.

| | |
|---|---|
| ***A63B 69/36*** | (2006.01) |
| *A63B 71/02* | (2006.01) |
| *A63B 71/06* | (2006.01) |

(52) U.S. Cl.

CPC ..... *A63B 69/3667* (2013.01); *A63B 69/3641* (2013.01); *A63B 69/3676* (2013.01); *A63B 2071/025* (2013.01); *A63B 2071/0694* (2013.01); *A63B 2207/02* (2013.01); *A63B 2210/50* (2013.01); *A63B 2225/09* (2013.01); *A63B 2225/12* (2013.01)

(58) Field of Classification Search

USPC ..... 473/218, 219, 220, 266, 270, 278, 257, 473/261, 264, 265

See application file for complete search history.

(56) References Cited

U.S. PATENT DOCUMENTS

| | | | | | |
|---|---|---|---|---|---|
| 3,312,474 | A | * | 4/1967 | Mitchell | 473/264 |
| 3,460,837 | A | | 8/1969 | Cassa, Jr. | |
| 3,656,752 | A | | 4/1972 | Moriarty | |
| 3,857,570 | A | * | 12/1974 | Gutierrez et al. | 473/264 |
| 3,934,874 | A | * | 1/1976 | Henderson | 473/265 |
| 3,942,802 | A | | 3/1976 | Wright | |
| 4,082,287 | A | * | 4/1978 | Berkey | 473/261 |
| 4,736,952 | A | | 4/1988 | Taft | |
| 4,869,510 | A | | 9/1989 | Battersby | |
| 5,375,833 | A | * | 12/1994 | Marier, Jr. | 473/261 |
| 5,503,395 | A | * | 4/1996 | Cook | 473/261 |
| 5,720,669 | A | * | 2/1998 | Pearson | 473/265 |
| 5,899,816 | A | | 5/1999 | Pearson | |
| 5,961,393 | A | | 10/1999 | Heller | |

(Continued)

FOREIGN PATENT DOCUMENTS

WO WO 2009/124944 A1 10/2009

OTHER PUBLICATIONS

The Product—SQRD UP: http://sqrdup.com/the-product Web Jul. 26, 2013.

(Continued)

*Primary Examiner* — Nini Legesse

(74) *Attorney, Agent, or Firm* — John A. Miller; Miller IP Group, PLC

(57) ABSTRACT

A golf swing training aid with a target-line guide, a rail, a clubface guide and an upright assembly. The target-line guide provides a straight line for aiming at a target. The rail runs parallel to the target-line guide and has a bottom for placing on a golfing surface. The clubface guide is perpendicular to the target-line guide and provides a straight line for a clubface of a golf club to parallel with when the golfer sets up or when the clubface passes over, under or through the clubface guide when a golfer swings the golf club. The upright assembly is attached to the rail and is constrained along a straight line on the rail, where the straight line is parallel to the target-line guide and where the upright assembly provides the clubface guide. The target-line and clubface guide can be a rod, a string, a series of laser dots, or a laser line.

21 Claims, 13 Drawing Sheets

(56) References Cited

U.S. PATENT DOCUMENTS

| | | | | |
|---|---|---|---|---|
| 6,048,273 | A | 4/2000 | Clement | |
| 6,129,639 | A * | 10/2000 | Brock et al. | 473/260 |
| 6,383,087 | B1 | 5/2002 | Moser | |
| 6,416,420 | B1 * | 7/2002 | Stark | 473/257 |
| 6,443,852 | B1 * | 9/2002 | Kim | 473/265 |
| 6,755,751 | B2 | 6/2004 | Chapman | |
| 6,949,030 | B1 | 9/2005 | Gauer | |
| 7,025,688 | B1 | 4/2006 | Hatzikostanti | |
| 7,063,626 | B2 | 6/2006 | Cardosi | |
| 7,134,966 | B1 | 11/2006 | Tice | |
| 7,238,118 | B1 | 7/2007 | Terrill | |
| 7,431,661 | B1 | 10/2008 | Cailey | |
| 7,455,596 | B1 | 11/2008 | Greene | |
| 7,670,231 | B1 | 3/2010 | Greene | |
| 7,914,392 | B2 | 3/2011 | Elliott | |
| 7,997,995 | B2 | 8/2011 | Willis | |
| 2008/0287206 | A1 | 11/2008 | Kinney | |
| 2009/0118028 | A1 | 5/2009 | Tischler, II | |
| 2011/0039629 | A1 | 2/2011 | Smith | |
| 2013/0102406 | A1 * | 4/2013 | Yu et al. | 473/278 |

OTHER PUBLICATIONS

Traineye Golf Putting Training Aid: http://traineye.com/product.html Web. Jun. 11, 2013.

* cited by examiner 28
42
38
36
32
34
40
44
30

38
50
48
46

28
42
44
52
50
32
34
54h
54g
54f
54e
54d
54c
54b
54a
30

GOLF CLUB FACE ALIGNMENT TRAINING AID

BACKGROUND OF THE INVENTION

1. Field of the Invention

This invention relates generally to a golf training aid and, more particularly, to a golf training aid that provides a target-line guide and a clubface guide for a golfer to use while practicing their golf swing to align their swing and clubface to the target line and improve their golf swing and alignment.

2. Discussion of the Related Art

A consistent problem for golfers learning to play is poor alignment of the clubface when they set up to hit a golf ball. Aiming the clubface in the right direction is very important for a golfer to control the direction of the golf ball. Studies have shown that the direction of the clubface determines 85% of the starting direction of the golf ball. Current practice tools often provide an artificial surface such as a mat or a hitting board, but what is preferred and most beneficial is to practice on a real grass golfing surface.

A need exists for a golf training aid that helps a golfer learn to align the clubface to be perpendicular to the target-line and allows the golfer to practice on a real grass golf surface.

SUMMARY OF THE INVENTION

In accordance with the teachings of the present invention, a golf training aid is disclosed that provides a target-line and clubface guide to help a golfer learn to improve the alignment of the clubface in the set up and during their swing. The golf training aid includes a target-line guide, a rail, an upright assembly and a clubface guide. The target-line guide provides a straight line for aiming at a golf target. The rail runs parallel to the target-line guide and has a bottom for placing on a golfing surface. The upright assembly is attached to the rail and is constrained along a straight line on the rail, where the straight line is attached to the rail and is parallel to the target-line guide and where the upright assembly provides the clubface guide. The clubface guide is perpendicular to the target-line guide and provides a straight line for the clubface to be parallel to in the golfer's set up and during the swing when the clubface passes over, passes under or passes through the clubface guide. The target-line guide can be a target-line rod, a small rod, a target-line string, a series of laser dots or a laser line. The clubface guide can be a rod, a series of laser dots, or a laser line.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a system for improving the swing and alignment of a golfer is merely exemplary, and is not intended to limit the invention or its applications or uses. Like numbers refer to like elements throughout the specification and drawings.

Figures 1, 2, 3:
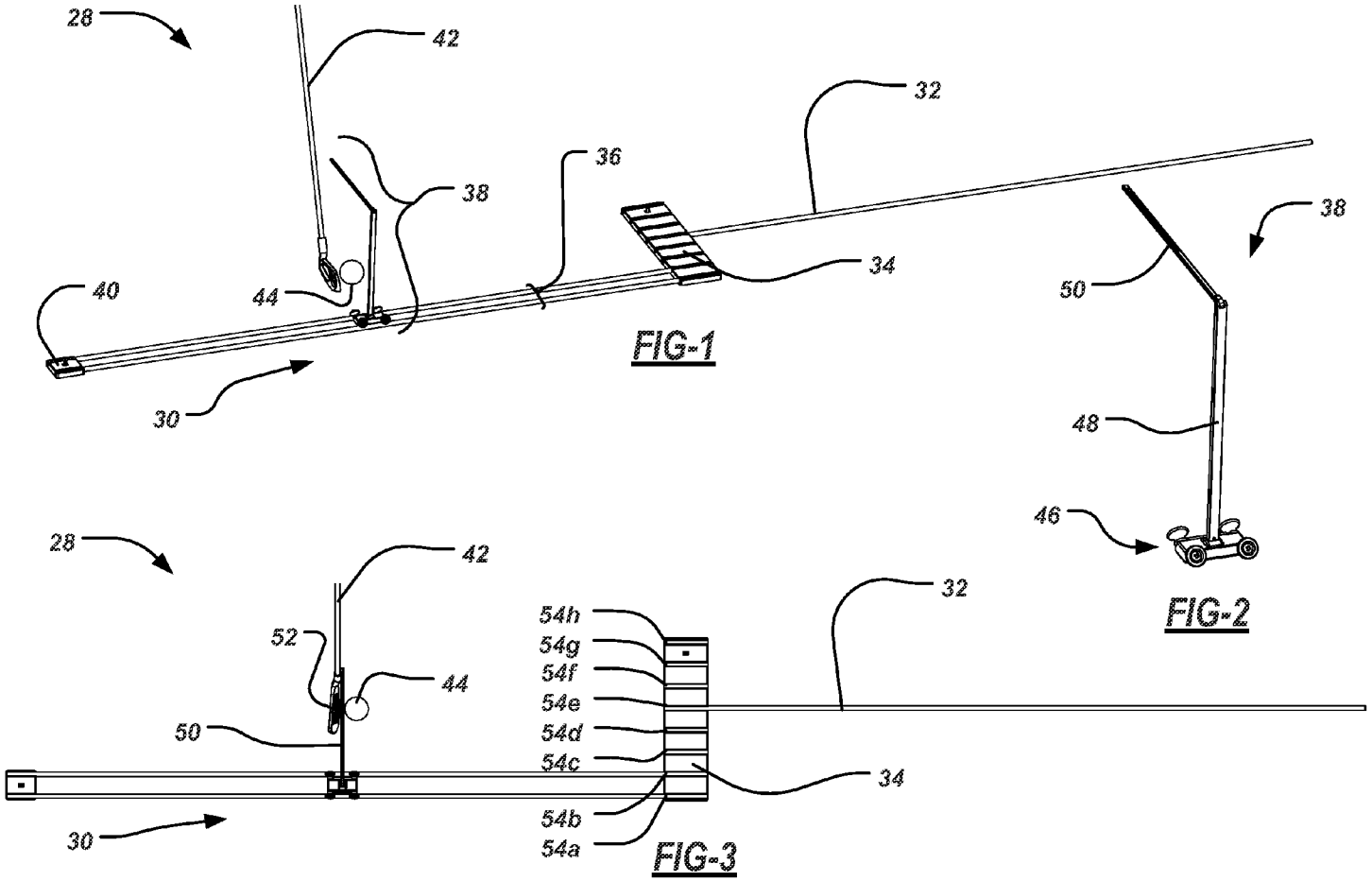
FIG. 1 is a perspective view of a golf training aid.
FIG. 2 is a perspective view of an upright assembly from the golf training aid of FIG. 1.
FIG. 3 is a top view of the golf training aid of FIG. 1.

FIG. 1 is a perspective view of a golf training setup 28 showing a golf training aid 30 in use with a golf club 42 and a golf ball 44. The golf training aid 30 includes a target-line rod 32 extending forward attached to a large clip 34 that is attached to parallel rods 36 extending rearward. An upright assembly 38 slides along the parallel rods 36. The parallel rods 36 make up a rail that attaches on the other end to a small clip 40, where the parallel rods 36 and the target line rod 32 are about forty-eight inches long and 0.4 inches in diameter.

FIG. 2 is a perspective view of the upright assembly 38 from the golf training aid 30 that has a rolling base 46, a vertical pole 48 and a horizontal rod 50. Attached to the rolling base 46 is the vertical pole 48 that extends up about eight inches and at the top has the horizontal rod 50 that extends away from the vertical pole 48 and away from the parallel rods 36 by about eight inches.

FIG. 3 is a top view of the golf training setup 28 that shows how the clubface 52 of the golf club 42 is aligned with the straight edge of the horizontal rod 50. When a golfer practices their swing, the horizontal rod 50 provides a straight edge and serves as a clubface guide, also known as the clubface alignment guide or clubface guideline. When the golfer practices their swing and the clubface 52 passes under the horizontal rod 50 the clubface 52 should be parallel to the horizontal rod 50, in this way the horizontal rod 50 serves as a clubface guide. The horizontal rod 50 can be adjustable so it can appear to the golfer to be above the golf club 42, but also not hitting or interfering with the golf swing. The horizontal rod 50 could be adjusted by attaching to the vertical pole 48 so it can extend and retract to enable the horizontal rod 50 to be above the swinging clubface 52 (from the perspective of the golfer) but not interfering with the golf club 42 during the swing. An alternative would be to allow the horizontal rod 50 to rotate up and down so the golfer can position the horizontal rod 50 to be visually above the clubface guide but not hitting the golf club 42 when the golfer swings. In addition, the golfer can align the golf ball 44 with the target-line rod 32. In FIG. 3, the target-line rod 32 aligns with the golf ball 44 when viewed from above.

The large clip 34 has a series of slots 54*a*, 54*b*, 54*c*, 54*d*, 54*e*, 54*f*, 54*g* and 54*h* with the slots spaced two inches apart. In use when a golfer is practicing hitting with a driver type golf club, the parallel rods 36 would attach to the two slots 54*a* and 54*b* on the end of the large clip 34. The target-line rod 32 would attach in the next slot 54*c* of the large clip 34 and be pointed at the target such that the target-line rod 32 indicates the target-line and provides the target-line guide, also known as the target-line alignment guide or target-line guideline. The golfer would place the golf ball 44 in-line with the target-line rod 32 as discussed above. The rear edge of the golf ball 44 can be visibly touching the horizontal rod 50 so that the horizontal rod 50 serves as a clubface guide (a reference feature that the clubface 52 should parallel) to align the swinging clubface 52 with when viewed from the golfer's perspective. The golfer's feet should form a line parallel to the rail, this line is also known as a foot line. With the golfer positioning the feet in parallel with the rail and the ball is in-line with the target-line rod, the golfer can minimize the error coming from their foot-line, and can reasonably assume any error in the line the ball takes to be related primarily to clubface misalignment. When the golfer hits the golf ball 44 he can try and ensure that the golf ball 44 goes straight over the target-line rod 32, or another person acting as an observer could provide feedback if the golf ball 44 traveled over the target-line rod 32.

In practice, the golfer can start by positioning the upright assembly 38 on the parallel rods 36 near the large clip 34 and the golfer would practice swinging in this location until the golfing surface was damaged, for example, with a divot. Then the golfer would move the upright assembly 38 back away from the large clip 34 to place the golf ball 44 on a fresh golfing surface. This process would repeat until the upright assembly 38 was at the end of the parallel rods 36, near the small clip 40.

Next, the golfer could move the target-line rod 32 to the next slot 54*d*, which is further away from the parallel rods 36. Again, the golfer would align the target-line rod 32 to the target to form the target-line guide. Then the golfer can repeat repositioning of the upright assembly 38, first starting near the large clip 34, and again repeatedly moving away from the large clip 34 to position the golf ball 44 on a good golfing surface. The golfer can continue repositioning the target-line rod 32 through the slots 54*e*, 54*f*, 54*g* and 54*h* until there are no more slots in the large clip 34.

In addition, the skill of the golfer can influence the slot in which the golfer places the target-line rod 32. An experienced golfer may prefer to place the target-line rod 32 closer to the parallel rods 36 so they can use the parallel rods 36 as a target-line guide that their swing should parallel when hitting the golf ball 44. A beginner golfer may prefer to place the target-line rod 32 further away from the parallel rods 36 because their swing is not as consistent and being further away helps ensure they avoid hitting the golf training aid 30.

The training setup 28 shows the golf training aid 30 setup for a right handed golfer, but the golf training aid 30 can also be configured for a left handed golfer by switching the two parallel rods 36 to slot 54*g* and 54*h* and rotating the upright assembly 38 by 180° when viewed from above. Similarly, the golf training aids described below can also be configured for left or right handed golfers.

Figure 4:
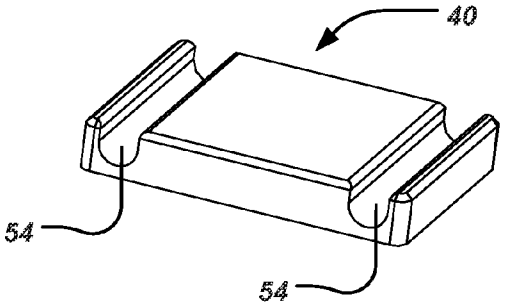
FIG. 4 is a perspective view of a small clip used in the golf training aid shown in FIG. 1.
Figure 5:
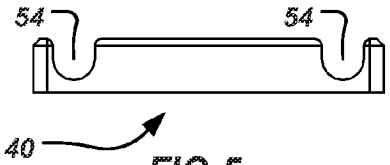
FIG. 5 is a side view of the small clip.

FIG. 4 is a perspective view and FIG. 5 is a side view of the small clip 40. The small clip 40 has two parallel slots 54 that the parallel rods 36 can fit into snugly.

Figure 6:
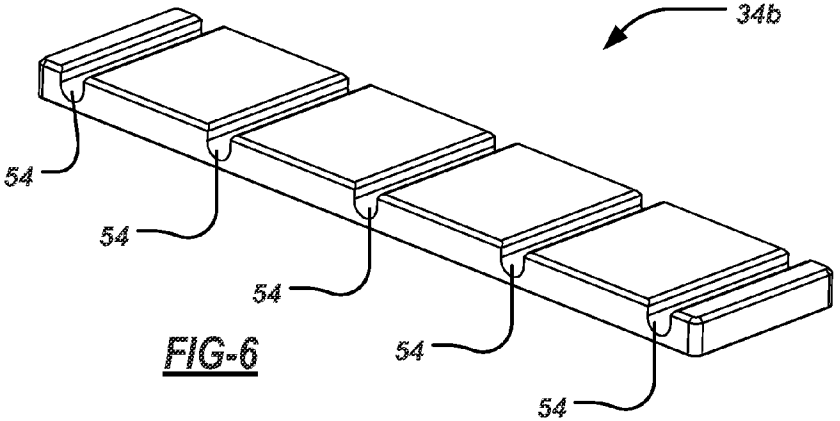
FIG. 6 is a perspective view of a large clip.
Figure 7:
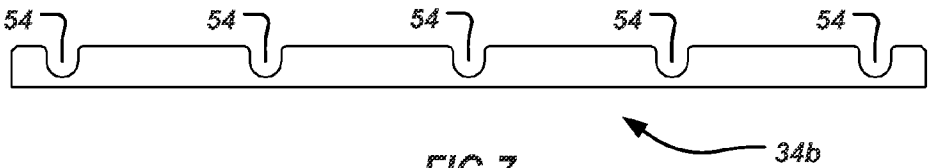
FIG. 7 is a side view of the large clip.

FIG. 6 is a perspective view and FIG. 7 is a side view of a large clip 34*b*. The large clip 34*b* has five parallel slots 54 that the rods (either the target-line rod 32 or the parallel rods 36) can fit in snuggly.

Figure 8:
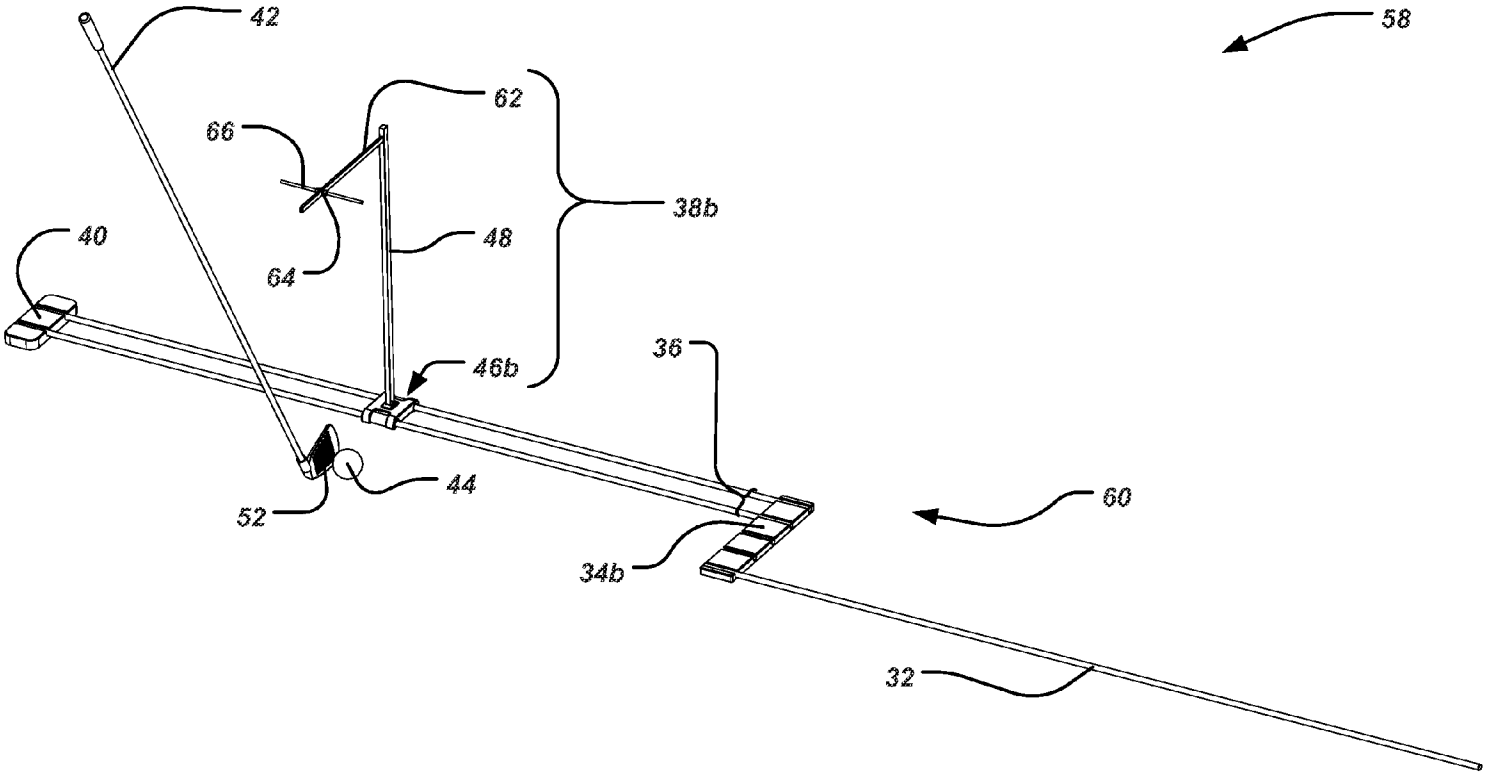
FIG. 8 is a perspective view of a golf training aid with a small target-line rod.

FIG. 8 is a perspective view of a training set-up 58 that shows using a golf training aid 60 where like elements to the training setup 28 are identified with the same reference numbers. The golf training aid 60 is similar to the golf training aid 30 with the exceptions that the large clip 34*b* replaces the large clip 34 and the upright assembly 38*b* replaces the upright assembly 38. The golf training aid 60 includes an upright assembly 38*b* that has a sliding base 46*b* attached to the parallel rods 36. Extending up from the sliding base 46*b* is the vertical pole 48 with a horizontal rod 62 attached at the top with a hole 64 holding a small target-line rod 66. The small target-line rod 66 runs parallel to or in line with the target-line rod 32 and provides a second target-line guide. On the golf training aid 60 the horizontal rod 62 serves as a clubface guide that the clubface 52 should parallel and the small target-line rod 66 serves as the target-line guide that the golf club swing should parallel when connecting with the golf ball 44.

Figure 9:
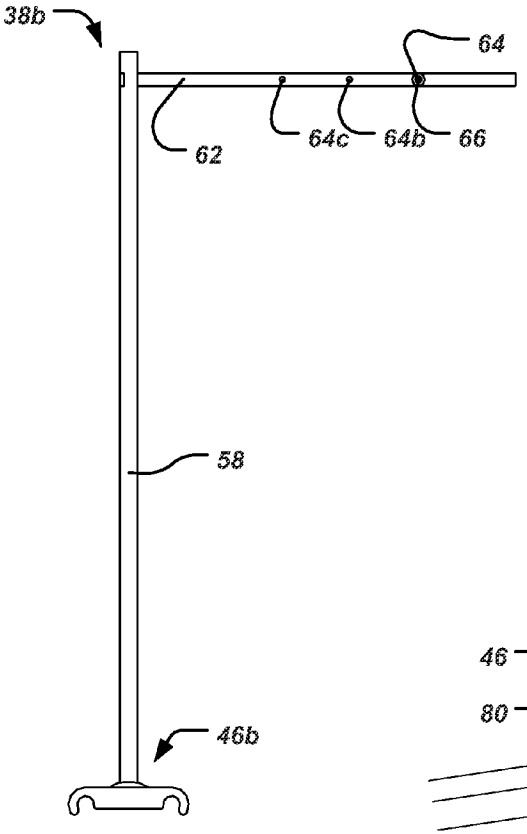
FIG. 9 is a side view of an upright assembly used in the golf training aid shown in FIG. 8.

FIG. 9 is a side view of the upright assembly 38*b* from the golf training aid 60. The horizontal rod 62 has the small target rod 66 extending out of the page. The small target rod 66 is shown in the hole 64, but it could also be placed in one of the other holes 64*b* or 64*c*, where the holes 64*b* or 64*c* are spaced two inches apart and can be aligned with the slots 54 in the large clip 34*b* from the golfer's perspective. In addition, the horizontal rod 62 could be adjustable where it connects to the vertical pole 48 as described above so the small target rod 66 aligns to the golf ball 44 from the golfer's perspective.

Figure 11A:
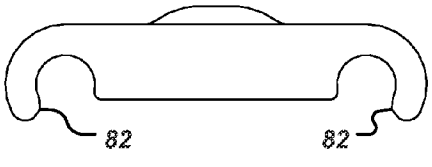
FIG. 11*a* is a side view of the base used in the upright assembly shown in FIG. 8.
Figure 11B:
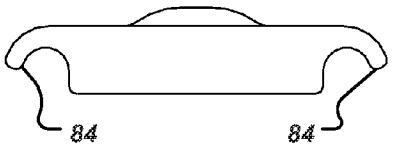
FIG. 11*b* is a side view of an alternative base for an upright assembly.
Figure 10:
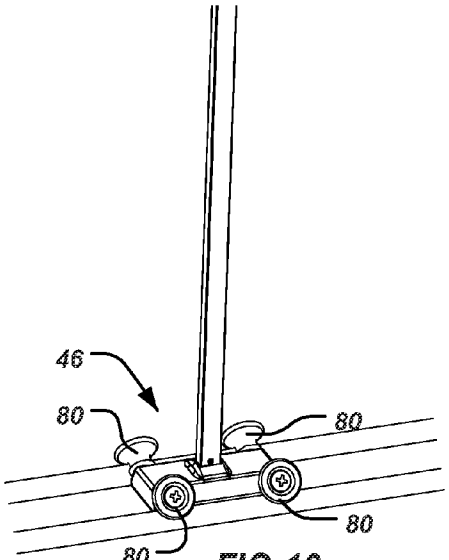
FIG. 10 is a perspective view of a wheeled base used in the upright assembly shown in FIG. 1.

FIGS. 10, 11*a* and 11*b* show different options for the base of the upright assembly. Specifically, FIG. 10 is a perspective view of the wheeled base 46, where the wheels 80 can roll along and help grasp the parallel rods 36. FIG. 11*a* is a side view of the base 46*b* that shows how the base 46*b* can have clips 82 that wrap around more than 50% of the circumference of the parallel rods 36 so the base will remain attached while the upright assembly slides to a new position on the parallel rods 36. FIG. 11*a* is a side view of a base 46*c* that illustrates how the clips 84 can be shallower and thus makes it easier to slide and reposition an upright assembly.

Figure 12:
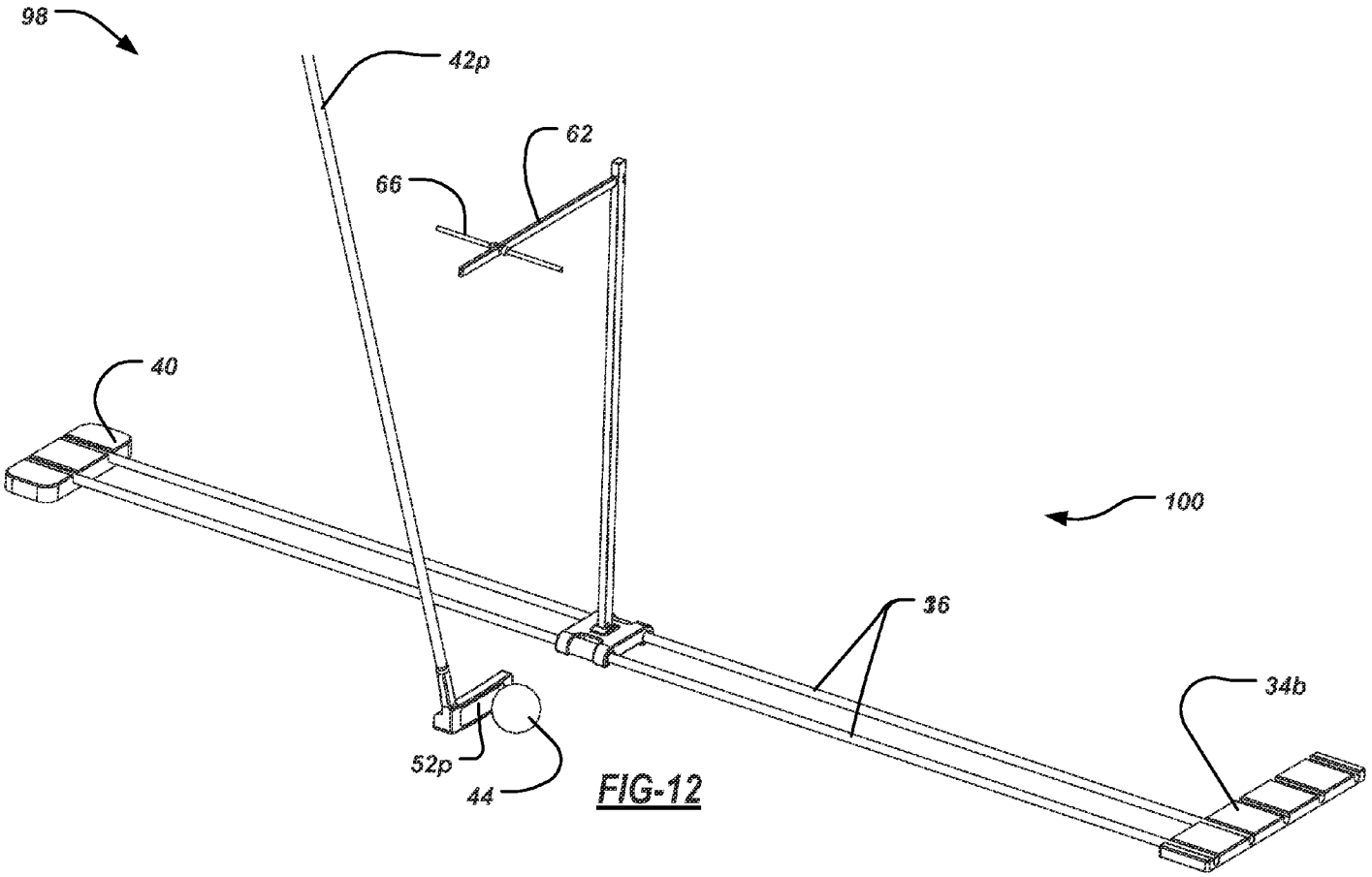
FIG. 12 is a perspective view of a golf training aid with a small target-line rod.

FIG. 12 is a perspective view of a golf training setup 98 that uses a golf training aid 100 with a putter 42*p* and the golf ball 44 where like elements to the training aid 60 are identified with the same reference numbers. The golf training aid 100 is well suited for practicing and improving alignment of the putting stroke. The golf training aid 100 is similar to the golf training aid 60 with the exceptions that it lacks the target-line rod 32 and the large clip 34*b* extends away from horizontal rod 62. This configuration enables the golfer to use the golf training aid 100 for putting practice since the large clip 34*b* does not block the travel of the golf ball 44.

Figure 13:
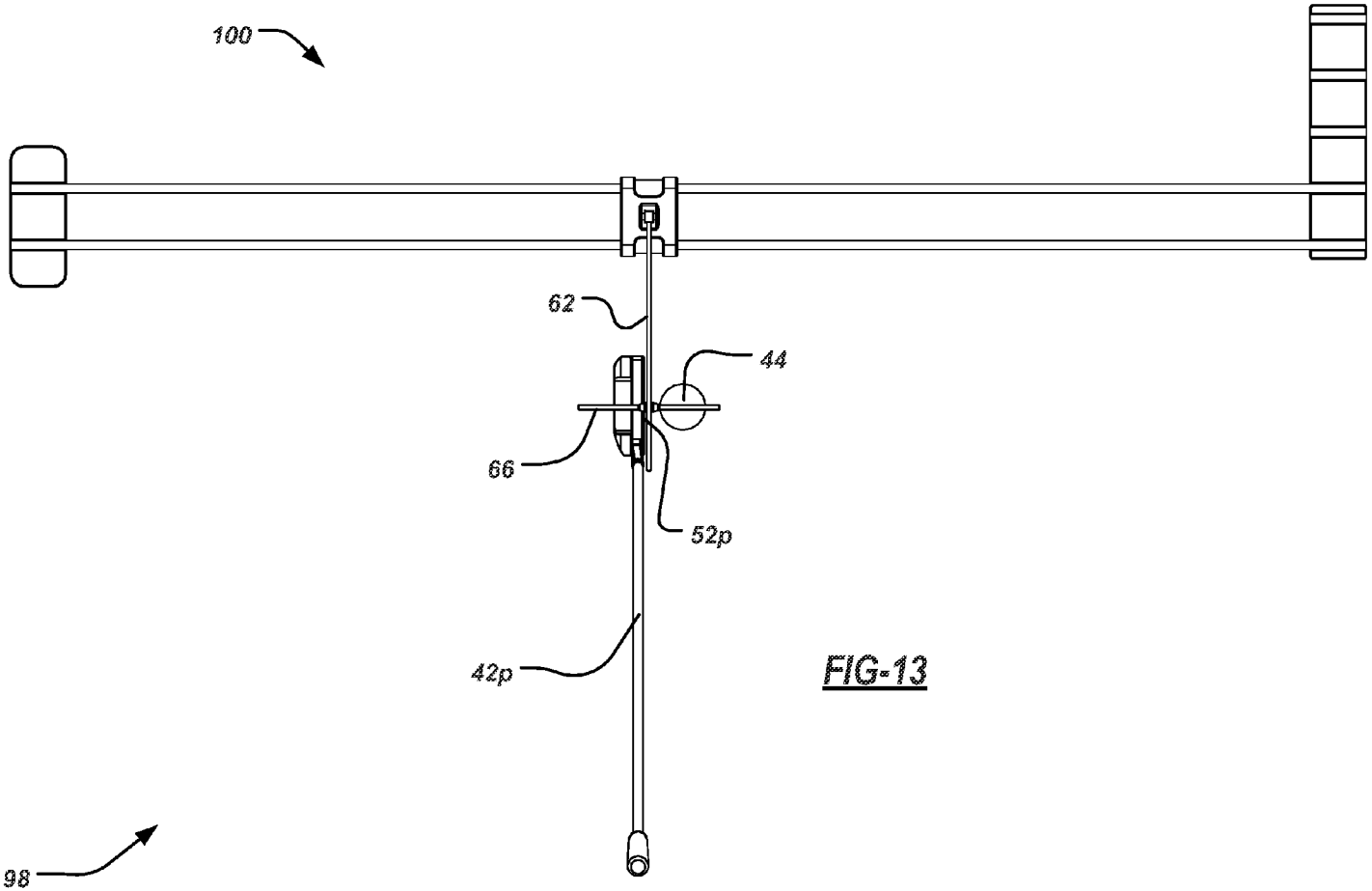
FIG. 13 is a top view of the golf training aid shown in FIG. 12.

FIG. 13 is a top view of the training set-up 98, where the small target-line rod 66 aligns with the center of the golf ball 44 to serve as the target-line guide and the horizontal rod 62 serves as the clubface guide for the putting clubface 52*p*. In practice, a golfer could look down on the golf ball 44 and adjust their position to align the small target rod 62 with the center of the golf ball 44, where the small target rod 62 serves as a target-line guide that the swing of the putting club 42*p* should parallel. In addition, the golfer would strive to have the clubface 52*p* parallel the horizontal rod 62 in the set up before the golfer swings and when the clubface 52*p* hits the golf ball 44.

Figure 14:
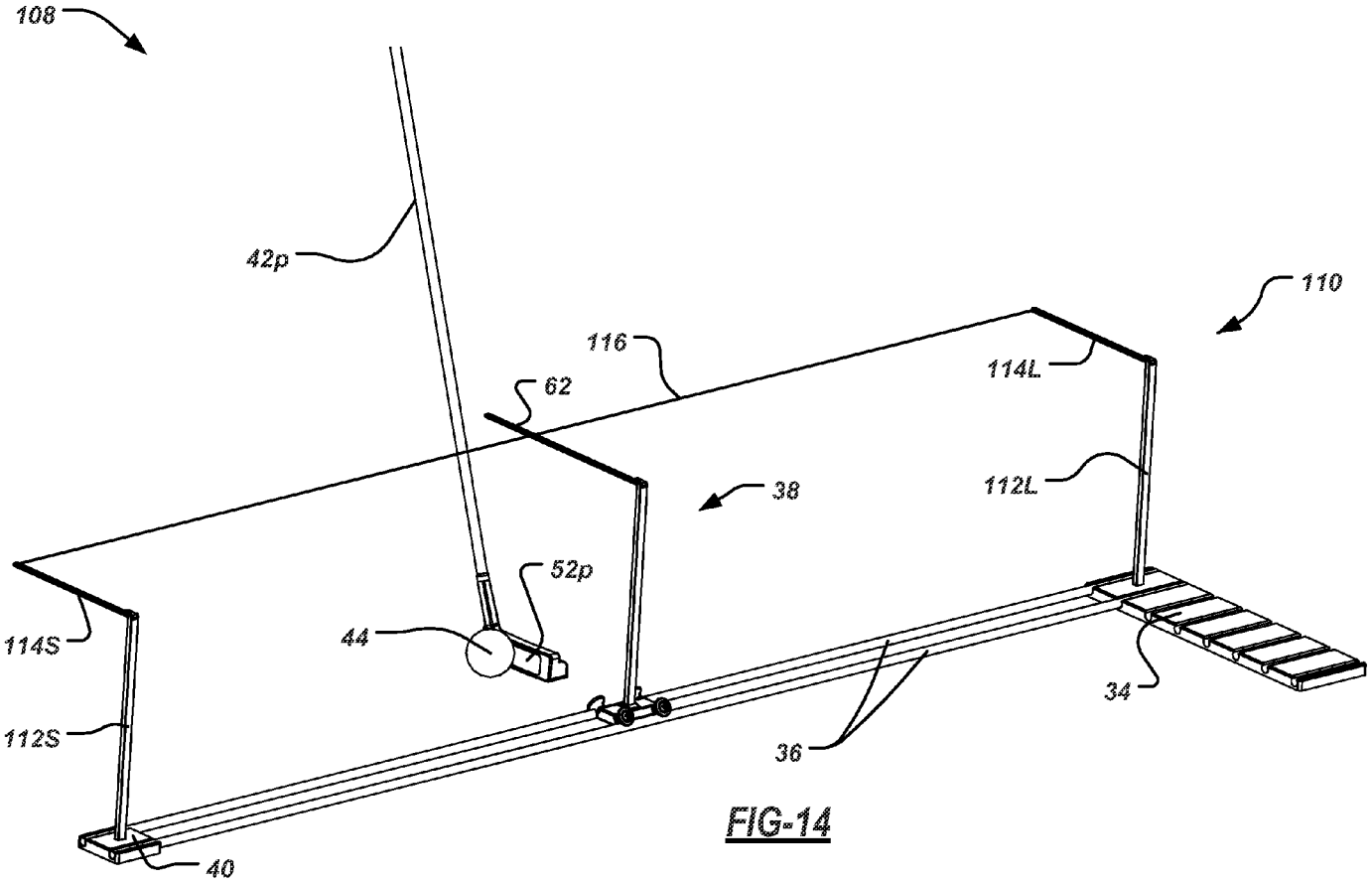
FIG. 14 is a perspective view of a golf training aid with a target-line string.
Figure 15:
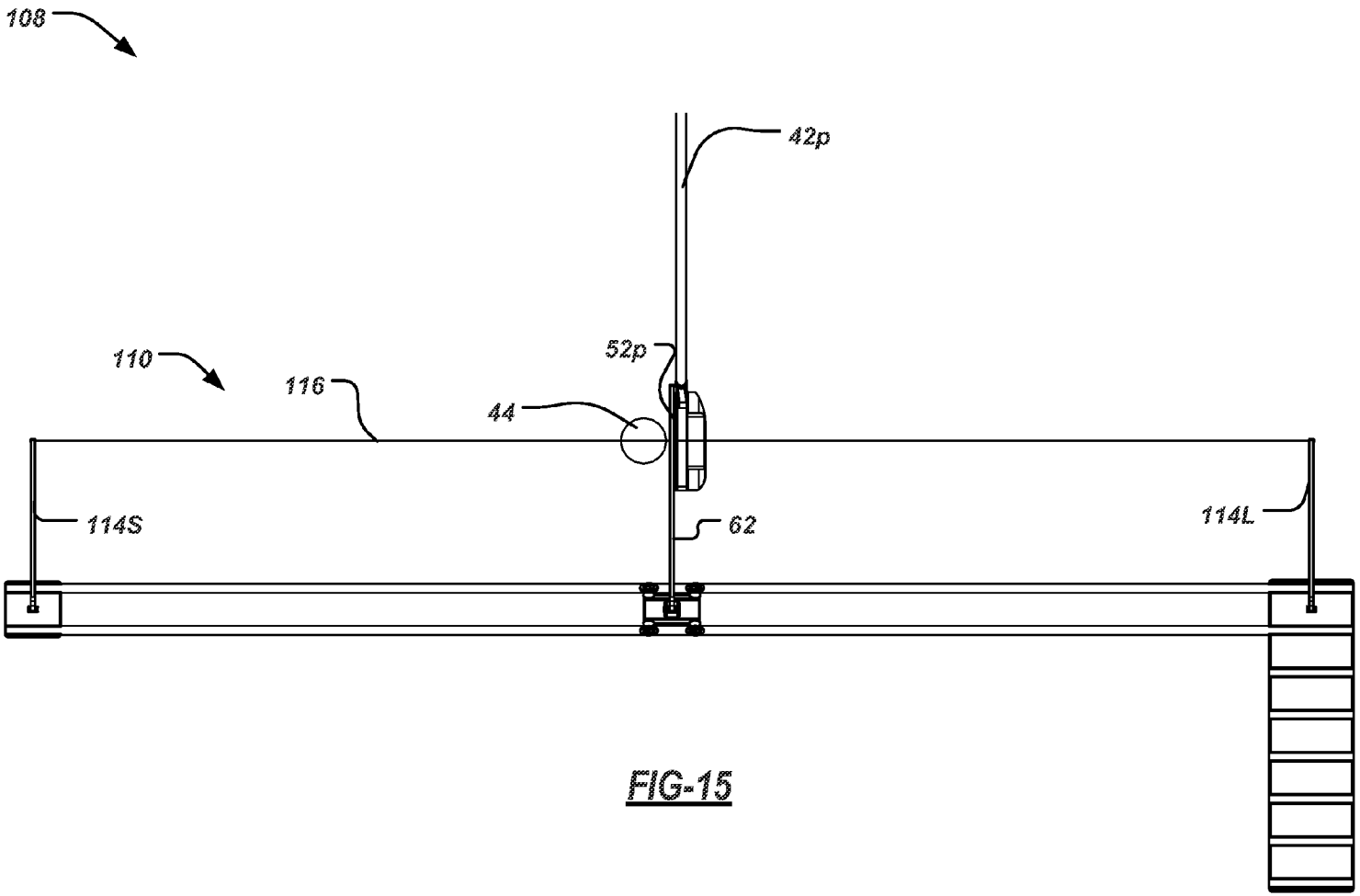
FIG. 15 is a top view of the golf training aid shown in FIG. 14.

FIG. 14 is a perspective view and FIG. 15 is a top view of a training setup 108 that includes a golf training aid 110 where like elements to golf training aid 30 are identified with the same reference numbers. The golf training aid 110 is particularly suited for practicing and improving the alignment of the clubface 52*p* and the putting stroke of a golfer. The golf training aid 110 has the large clip 34 with a front vertical pole 112L extending up with a front horizontal rod 114L at the top extending away from the parallel rods 36 that connect the large clip 34 to the small clip 40. Similarly, extending up from the small clip 40 is a rear vertical pole 112S with a rear horizontal rod 114S at the top that extends away from the parallel rods 36. Extending from the ends of the front horizontal rod 114S and the rear horizontal rod 114L is a string 116 that parallels the parallel rods 36. An upright assembly 38 moves along the parallel rods 36 and has a horizontal rod 62 positioned slightly above the target-line string 116.

FIG. 15 is a top view of the training setup 108 that shows how the target-line string 116 and the horizontal rod 62 serve as guides. The target-line string 116 forms the target-line guide that indicates the path the swing of the clubface 52*p* should parallel when the golfer putts. The horizontal rod 62 serves as a clubface guide that the clubface 52*p* should be parallel to in the set up and when the clubface 52*p* contacts the golf ball 44.

Figure 16:
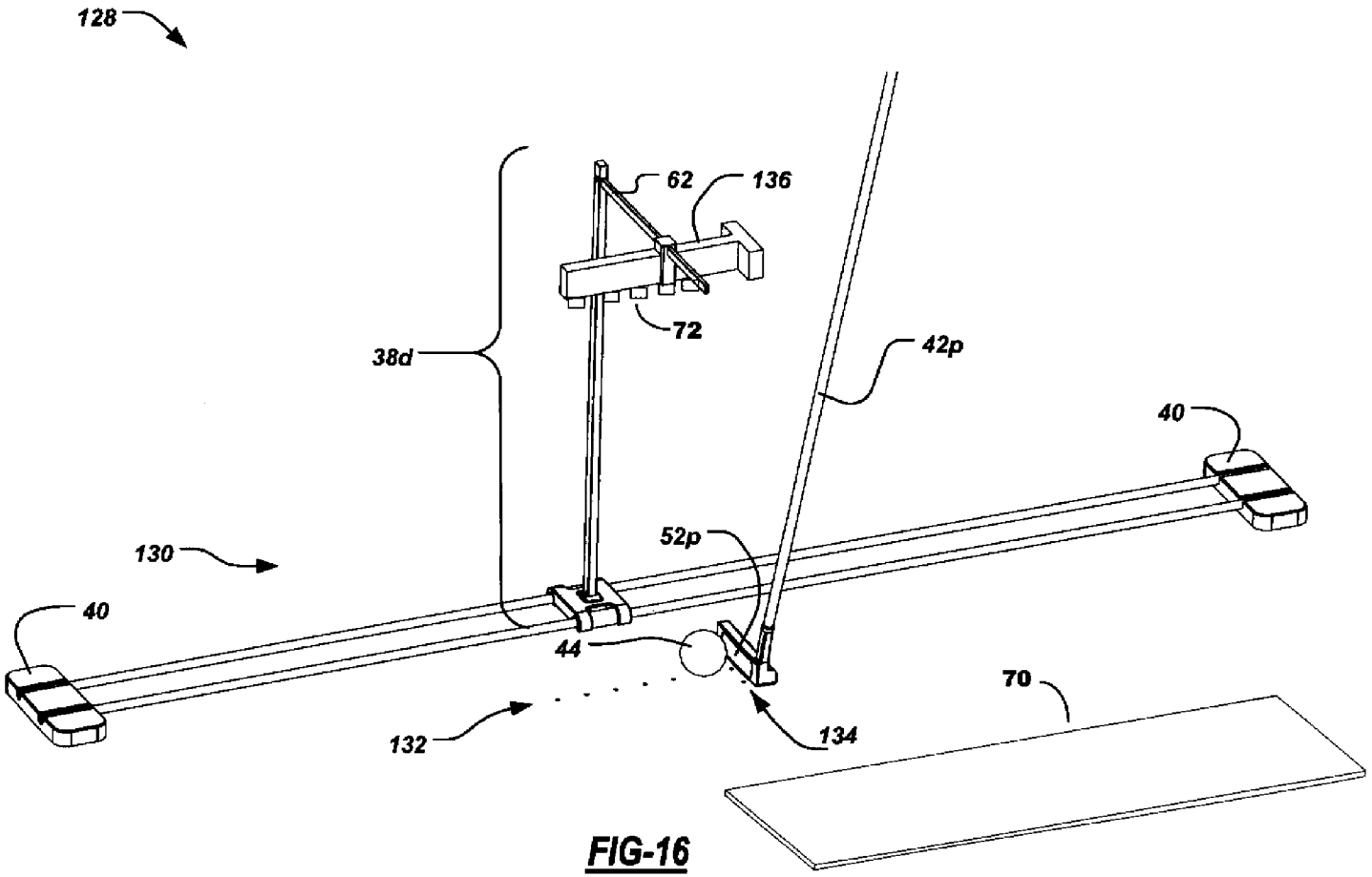
FIG. 16 is a perspective view of a golf training aid that projects dots of light to make the alignment guides.
Figure 17:
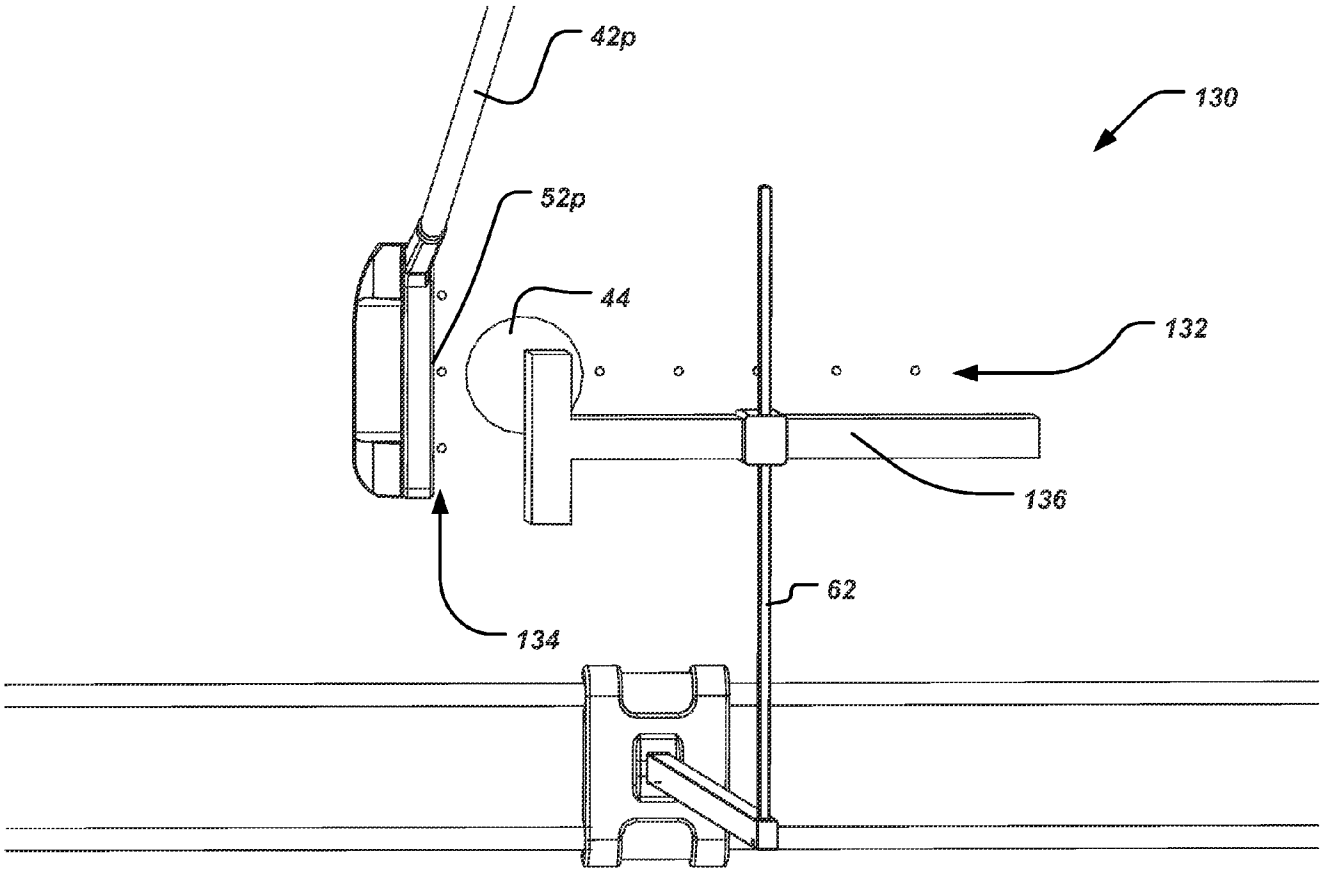
FIG. 17 is a perspective view from above of the golf training aid shown in FIG. 16.

FIG. 16 is a perspective view and FIG. 17 is a second perspective view from above of a training setup 128 where like elements to the training setup 98 are identified with the same reference numbers. The training setup 128 has a golf training aid 130 that has an upright assembly 38*d* with a "T" shaped light projector 136 that projects the alignment guides on the golfing surface. The "T" projector 136 can be seventeen inches above the golf surface. The "T" projector 136 can project bright dots onto the golfing surface to provide the alignment guides. More specifically the dots that make the "T" up-down stroke 132 provide a target-line guide and the dots on the "T" top-bar 134 provide a clubface guide. FIG. 16 shows the "T" up-down stroke 132 with five dots of lights and the "T" top-bar 134 with three dots of light. A space can exist between the top of the "T" up-down stroke 132 and the "T" top-bar 134 for the golf ball 44 to reside. A laser or multiple lasers 72 can create the dots of light. For example, each dot of light can be generated by separate individual lasers held together in the "T" shape holder, this way the dots are their brightest, which helps enable the golf training aid 130 to be used in daylight. The golf training aid 130 has the "T" projector 136 projecting light straight down and parallel to make the set of dots of light the same size as the "T" projector 136. Another option would be to have the laser lines not parallel but rather splayed to project onto the golfing surface a "T" that is significantly bigger than the "T" projector 136 making the up down stroke of the "T" 132 longer extending the target-line even farther in front of the golfer.

In practice, a golfer can align the training aid 130 using the "T" up-down stroke 132 as the target-line to aim at the golf target or they could use the long edge of the "T" projector 136 to aim the golf training aid 130. Once aligned to the golf target, the "T" up-down stroke 132 can be in front of the golf ball 44 to check that the golfer hit the golf ball 44 in the direction of the "T" up-down stroke 132. Another option would be to have the "T" up-down stroke 132 behind the golf ball 44 to ensure the swing is straight in practice and approach for the actual hit. The "T" top-bar laser projection can appear on the clubface when the club passes through the light projections and can provide feedback to the golfer about the alignment of the clubface to the clubface guide.

Figure 18:
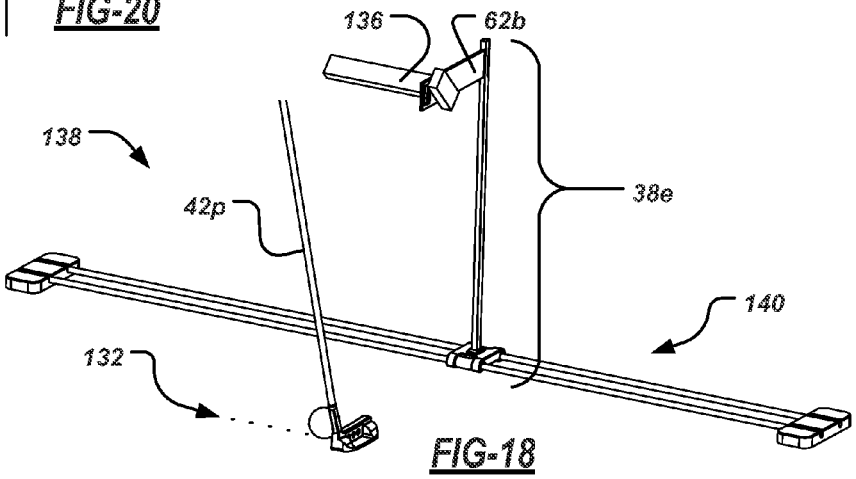
FIG. 18 is a perspective view of a golf training aid where a "T" projector is angled away from the golf training aid.
Figure 19:
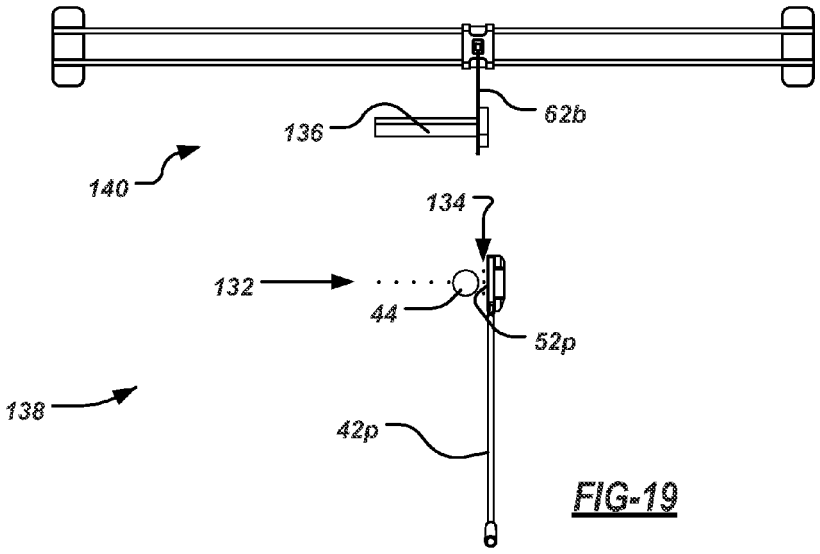
FIG. 19 is a top view of the golf training aid shown in FIG. 18.

FIG. 18 is a perspective view and FIG. 19 is a top view of a training setup 138 where like elements to the training setup 128 are identified with the same reference numbers. The training setup 138 has a golf training aid 140 where the "T" projector 136 is angled away from the golf training aid 140 so the guides appear on the golf surface to the side of the golf training aid 140. With this configuration, the view of the golfer is unencumbered by the golf training aid 140. The golf training aid 140 has an upright assembly 38*e* including a horizontal rod 62*b* with a flat surface in the vertical direction.

Figure 20:
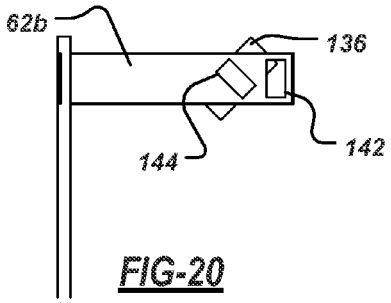
FIG. 20 is a left side view of a horizontal arm of the golf training aid shown in FIG. 18.

FIG. 20 is a left side view of the horizontal rod 62*b* showing an angled cut out 144 that holds the "T" projector 136 at a 45° angle and projects the guides away from the golf training aid 140. The horizontal rod 62*b* has a second cut-out that is a vertical cut-out 142 to position the "T" projector 136 in the vertical direction so that the dots would be projected straight down and appear directly below the "T" shaped laser projector, similar to golf training aid 130.

Another possibility for attaching the "T" shaped projector 136 is a mechanism that would allow the golfer to adjust the angle that the projector projects away from the golf training aid 140. The attachment mechanism could be a pivotal assembly that either allows the "T" projector 136 to ratchet to specific angles or clamp into an appropriate angle selected by the golfer, or any other means that would enable the "T" projector 136 to be held at a selectable angle. Similarly, a golf training aid embodiment could use a mirror to project the laser lights away from the golf training aid embodiment.

Figure 21:
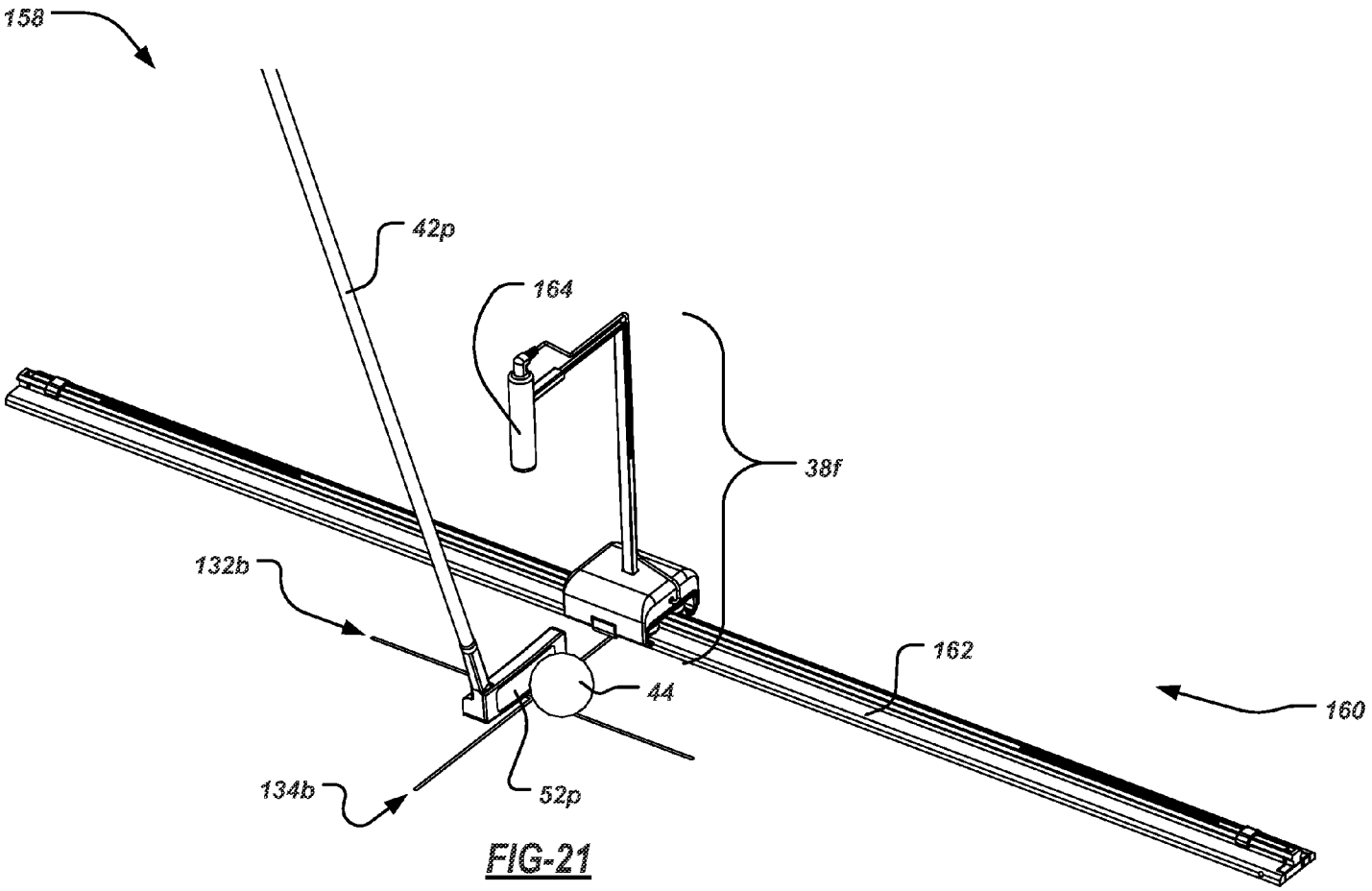
FIG. 21 is a perspective view of a golf training aid that projects lines of light on the golf surface.

FIG. 21 is a perspective view of a training setup 158 where like elements to the training setup 128 are identified with the same reference numbers. The training setup 158 has a golf training aid 160 that includes an upright assembly 38*f* that moves along a rail 162. At the top of the upright assembly 38*f* is a plus projector 164 that projects a plus sign on the golf surface on which the golf ball 44 rests. The plus projector 164 can use one or more lasers along with movement, e.g. movement of a mirror or other optical equipment, to provide the appearance of a continuous line on the golfing surface. The swing of the putter 42*p* should follow plus-sign vertical line 132*b*, which provides the target-line guide. The clubface 52*p* should parallel to the plus-sign horizontal line 134*b*, which provides the clubface alignment guide.

Figure 22:
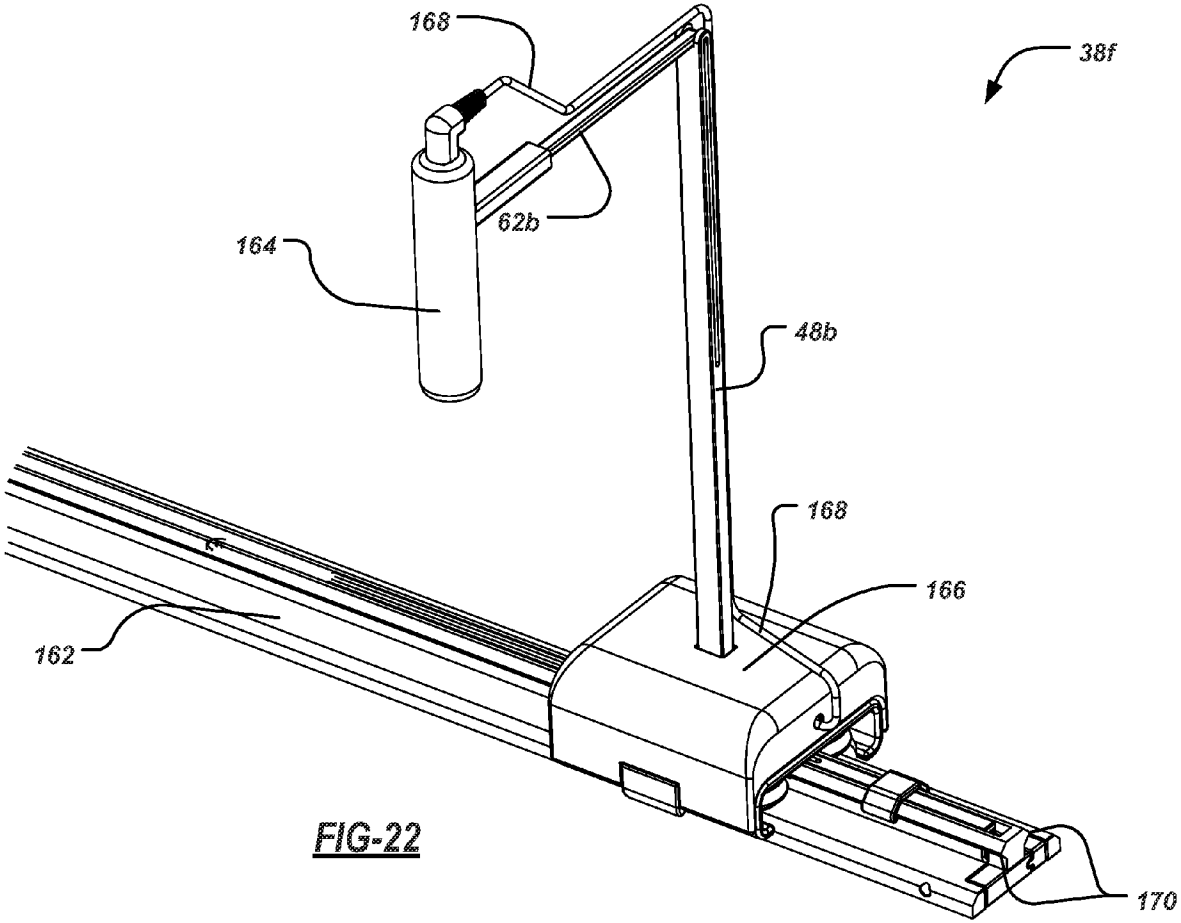
FIG. 22 is a perspective view of the upright assembly from the golf training aid shown in FIG. 21.

FIG. 22 provides a close-up perspective view of the upright assembly 38*f* that has a base 166 with the vertical pole 48*b* extending up and a horizontal rod 62*b* attached at the top with a plus laser projector 164 on the end. In the base 166 are batteries and their electricity is provided to the plus laser projector 164 via a wire 168. The base 166 connects to the rail 162 with bearings that contact the "V" shape 170 of the rail 162. By having the batteries in the base 166 more weight is closer to the golf surface and the plus projector 164 is lighter weight which makes the upright assembly 38*f* more stable.

An additional element that an embodiment of the golf training aid could include is a reflective surface 70, such as a mirror, see FIG. 16. The reflective surface 70 could be approximately six inches wide by twenty-four inches long and would be placed or attached in parallel to the rail. In practice, the golfer would align their feet to the edge of the reflective surface 70 where the golfer uses the reflective surface 70 to square their shoulders to the target-line.

Although this specification shows the upright assembly as composed of three parts, that is not a requirement of the upright assembly. The drawings show a number of upright assemblies constructed with a base, a vertical pole and a horizontal rod, but an upright assembly can be constructed in many ways so long as it provides alignment guides either for the target-line, clubface or both the target-line and clubface guides. The upright assembly could be a single member extending at an angle from the base, or it could have a curved member or any other shape or device that can provide a guide.

Although, this specification describes the base as sliding on the rail this description does not require surfaces to be sliding past each other. The sliding movement could involve wheels or ball bearings where no surfaces are in sliding contact. In addition, the sliding movement could involve lifting the base from the rail and placing it at a different location on the rail.

The golf alignment training aids described above allows a golfer to take practice swings and then reposition the guides while keeping the alignment of the target-line. The golfer can move the upright assembly to a new position when they create divots, so this embodiment holds the advantage of keeping the alignment so the golfer can work on getting the ball on the target even if the swings damage the golfing surface.

The foregoing discussion discloses and describes merely exemplary embodiments of the present invention. One skilled in the art will readily recognize from such discussion and from the accompanying drawings and claims that various changes, modifications, combinations and variations can be made without departing from the spirit and scope of the invention as defined in the following claims.

Give all terms used in the claims their broadest reasonable construction and their ordinary meaning as understood by those skilled in the art. Use of the singular articles such as "a", "the", "said", etc. should be read to recite one or more of the indicated elements.

What is claimed is:

1. A golf swing training system comprising:

a target-line guide that provides a straight line for aiming at a golf target;

a rail that runs parallel to the target-line guide and includes a bottom for placing on a golfing surface, said rail including a large clip at one end of the rail and a small clip at an opposite end of the rail, where the small clip includes two parallel slots and the large clip includes three or more parallel slots, said rail further including two parallel rods where one end of each rod is secured to the large clip and an opposite end of each rod is coupled to the small clip; and an upright assembly slidably mounted to and constrained along a length of the rail in a direction parallel to the target-line guide, said upright assembly including a clubface guide that is perpendicular to the target-line guide and the rail, said clubface guide providing a straight line for aligning a clubface of a golf club during a golfer's set up where the clubface passes over, passes under or passes through the clubface guide when the golfer swings the golf club.

2. The system of claim 1 where the upright assembly includes a base that is positionable along the rail.

3. The system of claim 1 where the clubface guide is a straight edge on the upright assembly.

4. The system of claim 3 where the upright assembly includes a small target-line rod that is perpendicular and attached to the straight edge.

5. The system of claim 4 where the straight edge has several places that the small target-line rod can attach.

6. The system of claim 5 where the two slots of the small clip are spaced the same as the three or more slots of the large clip, and where the several places that the small target-line rod can attach to are spaced the same as the three or more slots.

7. The system of claim 1 where the target-line guide is a rod that is secured within one of the slots in the large clip and extends forward from the rail.

8. The system of claim 1 where the target-line guide is a target-line string attached on one end to a front assembly that is attached to the large clip and attaches at the other end to a rear assembly that is attached to the small clip, where the string is parallel to the rail when viewed from above.

9. The system of claim 1 where the upright assembly includes a base that slides along the rail with a clip that encircles more than 50% of the two rods.

10. The system of claim 1 further including a reflective surface with an edge that is parallel to the target-line guide for a golfer to align their feet with and where the golfer can use the reflective surface for squaring their shoulders.

11. A golf swing training system comprising:

a rail that has a bottom for placing on a golfing surface, said rail including a large clip at one end of the rail and a small clip at an opposite end of the rail, where the small clip includes two parallel slots and the large clip includes three or more parallel slots, said rail further including two parallel rods where one end of each rod is secured to the large clip and an opposite end of each rod is coupled to the small clip;

a base attached to the rail where the base is repositionable along a line that parallels a direction of the rail and where the base extends upward from the rail and provides a clubface guide perpendicular to the rail, said clubface guide providing a straight line for aligning a clubface of a golf club during a golfer's set up where the clubface passes over, passes under or passes through the clubface guide when the golfer swings the golf club; and a target-line guide that is a straight line and is parallel to the direction of the rail.

12. A golf training system comprising:

a rail that has a bottom that is to be placed on a golfing surface;

an upright assembly that is attached to the rail where the upright assembly moves linearly in a direction parallel to the rail and provides a clubface guide and a target-line guide, where the target-line guide is parallel to the rail and the clubface guide is perpendicular to the target-line guide; and a series of lasers mounted to the upright assembly that produces the clubface guide or the target-line guide by a series of dots of light that are projected onto the golfing surface.

13. The system of claim 12 where the upright assembly includes a base that slides along the rail.

14. A golf swing training system comprising:

a target-line guide that provides a straight line for aiming at a golf target;

a rail that runs parallel to the target-line guide and includes a bottom for placing on a golfing surface; and an upright assembly slidably mounted to and constrained along a length of the rail in a direction parallel to the target-line guide, said upright assembly including a clubface guide that is perpendicular to the target-line guide and the rail, said clubface guide providing a straight line for aligning a clubface of a golf club during a golfer's set up where the clubface passes over, passes under or passes through the clubface guide when the golfer swings the golf club, where one or both of the target-line guide or clubface guide are formed by light projected from the upright assembly to the golfing surface.

15. The system of claim 14 where the upright assembly has a base that slides along the rail and where the base contains batteries used to produce the light projections.

16. The system of claim 14 where at least one of the target-line guide or the clubface guide is formed by a continuous line of light.

17. The system of claim 14 where at least one of the target-line guide or the clubface guide is formed by a set of dots of light forming a line.

18. The system of claim 17 where each dot of light is from a separate laser.

19. The system of claim 18 where the clubface guide is composed of three dots of light and the target-line guide is composed of five dots of light.

20. The system of claim 14 where at least one of the target-line guide or the clubface guide is projected straight down from the upright assembly.

21. The system of claim 14 where at least one or both of the target-line guide or the clubface guide is projected at an angle away from the upright assembly.

* * * * *